US009976395B2

(12) United States Patent
Noffke

(10) Patent No.: US 9,976,395 B2
(45) Date of Patent: May 22, 2018

(54) EXPANDABLE TIE BACK SEAL ASSEMBLY

(75) Inventor: Richard Paul Noffke, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 438 days.

(21) Appl. No.: 14/424,610

(22) PCT Filed: Aug. 28, 2012

(86) PCT No.: PCT/US2012/052721
§ 371 (c)(1),
(2), (4) Date: Feb. 27, 2015

(87) PCT Pub. No.: WO2014/035380
PCT Pub. Date: Mar. 6, 2014

(65) Prior Publication Data

US 2015/0198006 A1 Jul. 16, 2015

(51) Int. Cl.
*E21B 43/10* (2006.01)

(52) U.S. Cl.
CPC ..... *E21B 43/103* (2013.01); *E21B 43/108* (2013.01)

(58) Field of Classification Search
CPC ..... E21B 33/128; E21B 43/103; E21B 23/06
See application file for complete search history.

(56) References Cited

U.S. PATENT DOCUMENTS 3,425,719 A * 2/1969 Burton ..... F16L 13/161 285/382.2
4,298,221 A 11/1981 McGugan
6,457,532 B1 * 10/2002 Simpson ..... B21D 17/04 166/207
9,057,260 B2 * 6/2015 Kelbie ..... E21B 43/103
2002/0079106 A1 * 6/2002 Simpson ..... B21D 17/04 166/380
2003/0047323 A1 * 3/2003 Jackson ..... E21B 43/103 166/380
2003/0102127 A1 6/2003 Braddick
2004/0055758 A1 3/2004 Brezinski et al.
2004/0060706 A1 4/2004 Stephenson
2004/0069498 A1 4/2004 Simpson et al.
2004/0104575 A1 6/2004 Ellington et al.
(Continued)

FOREIGN PATENT DOCUMENTS

GB 2383605 A 6/2003
WO 95/25239 A1 9/1995
(Continued)

OTHER PUBLICATIONS

Extended European Search Report issued by the European Patent Office regarding related European Patent Application No. 12883822.4, dated Mar. 24, 2016, 9 pages.
(Continued)

*Primary Examiner* — Michael R Wills, III
(74) *Attorney, Agent, or Firm* — Haynes and Boone LLP

(57) ABSTRACT

Disclosed are apparatus and methods for completing a wellbore, using expandable tubular to form a sealed connection. More particularly, embodiments of the present invention relate to forming a seal between a radially expanded tubular and a receptacle, wherein annular-shaped, radially extending protrusions are present between the tubular and the receptacle to form a durable sealed connection therebetween.

23 Claims, 3 Drawing Sheets

(56) References Cited

U.S. PATENT DOCUMENTS

| | | | | |
|---|---|---|---|---|
| 2004/0148758 | A1* | 8/2004 | Lohbeck | E21B 17/042 29/523 |
| 2004/0216889 | A1 | 11/2004 | Fraser, III | |
| 2004/0244968 | A1* | 12/2004 | Cook | A47B 43/00 166/242.6 |
| 2005/0184521 | A1 | 8/2005 | Maguire | |
| 2006/0087119 | A1 | 4/2006 | Sivley, IV et al. | |
| 2006/0124295 | A1* | 6/2006 | Maguire | E21B 43/103 166/207 |
| 2006/0208488 | A1 | 9/2006 | Costa | |
| 2006/0254779 | A1 | 11/2006 | Lynde | |
| 2007/0240877 | A1 | 10/2007 | O'Malley et al. | |
| 2008/0308283 | A1 | 12/2008 | Freyer | |
| 2010/0078178 | A1 | 4/2010 | Watson | |
| 2010/0089591 | A1* | 4/2010 | Thomson | E21B 17/08 166/382 |
| 2011/0308793 | A1 | 12/2011 | Fenton | |
| 2013/0248209 | A1* | 9/2013 | Watson | E21B 43/103 166/387 |
| 2014/0238692 | A1* | 8/2014 | Watson | E21B 43/103 166/382 |
| 2014/0311751 | A1 | 10/2014 | Hallundbaek et al. | |

FOREIGN PATENT DOCUMENTS

| | | |
|---|---|---|
| WO | WO 2005/113190 | 12/2005 |
| WO | 00/37772 A1 | 6/2009 |

OTHER PUBLICATIONS

Office Action issued by the Canadian Intellectual Property Office regarding Canadian Patent Application No. 2,883,687, dated Feb. 8, 2016, 4 pages.

Patent Examination Report No. 1 issued by the Australian Government, IP Australia, regarding Australian patent application No. 2012388782, dated Nov. 27, 2015, 6 pages.

First Office Action issued by the State Intellectual Property Office of the People's Republic of China regarding related Chinese Patent Application No. 201280075560.2, dated Aug. 17, 2016, 9 pages.

International Search Report and Written Opinion issued by Korean Intellectual Property Office for PCT/US2012/052721 dated Mar. 22, 2013, 10 pages.

Written Opinion issued by the Intellectual Property Office of Singapore regarding related Singapore Patent Application No. 11201501512W, dated Apr. 11, 2017,6 pages.

* cited by examiner

EXPANDABLE TIE BACK SEAL ASSEMBLY

CROSS REFERENCE TO RELATED APPLICATIONS

None.

BACKGROUND

Technical Field

The present invention relates to equipment and methods used in subterranean wells and, more particularly, to an expandable tie back seal.

Background Art

Wellbores are typically formed by drilling and thereafter lining a borehole with steel pipe called casing. The casing provides support to the wellbore and facilitates the isolation of certain areas of the wellbore adjacent hydrocarbon bearing formations. The casing typically extends down the wellbore from the surface of the well and the annular area between the outside of the casing and the borehole in the earth is filled with cement to permanently set the casing in the wellbore.

As the wellbore is drilled to a new depth, additional strings of pipe are run into the well to that depth, whereby the upper portion of the string of pipe or liner is overlapping the lower portion of the casing. The liner string is then fixed or hung in the wellbore, usually by some mechanical slip means, well known in the art.

In some instances, wells are completed with the remote perforating of liner to provide a fluid path for hydrocarbons to enter the wellbore where they flow into a screened portion of another smaller tubular or production tubing. In these instances, the wellbore around the tubing is isolated with packers to close the annular area and urge the hydrocarbons into the production tubing. In other completions, the last string of liner extending into the wellbore is itself pre-slotted or perforated to receive and carry hydrocarbons upwards in the wellbore. In these instances, production tubing is usually connected to the to of the liner to serve as a conduit to the surface of the well. In this manner, the liner is "tied back" to the surface of the well.

In order to complete these types of wells, the production tubing is inserted in the top of a liner in a sealing relationship, usually accomplished by the use of a polished bore receptacle in the liner top. A polished bore receptacle has a smooth cylindrical inner bore designed to receive and seal a tubular having a seal assembly on its lower end. The polished bore receptacle and seal assembly combination allows the production tubing to be "stung" into the liner in a sealing relationship and be selectively removed there from. As used herein, the term "polished bore receptacle" refers to a device used to locate and seal a first tubular in a second tubular.

Well-known technology permits wellbore tubular members to be expanded in situ. In addition to simply enlarging a tubular, the technology permits the physical attachment of a smaller tubular to a larger tubular by increasing the outer diameter of a smaller tubular with radial force from within. The expansion can be accomplished by a mandrel or a cone-shaped member urged through the tubular to be expanded or by an expander tool run in on a tubular string. For an example of an expander tool see: U.S. Pat. No. 7,779,910, issued Aug. 24, 2010 to Watson, entitled "Expansion Cone For Expandable Liner Hanger", which is incorporated herein by reference for all purposes. Additionally, the term "expander tool" is used herein to refer to any member that used to expand a tubular, such as the roller expander tool, a cone member, hydraulic pressure or any other type of expansion member used in the oil and gas industry.

Tie back seals typically incorporate elastomers at the seal interface. Caustic fluids, high temperatures and high pressures encountered downhole often precipitate degradation of elastomeric seals. Degraded seals can develop leaks that can be costly to an operation whether left in place or replaced. When left in place, the quality of a production stream can suffer. When replaced, the cost of equipment and labor as well as costs of lost production, during replacement downtime, will accumulate. Accordingly, there is a need in the art for a highly durable tie back seal without elastomers that provides a reliable seal.

SUMMARY OF THE INVENTIONS

Embodiments of the present invention generally relate to methods and apparatus for completing a well. Particularly, the invention relates to a system of completing a wellbore through the expansion of tubular. More particularly, embodiments of the present invention relate to a tie back seal system, wherein the first tubular contains a polished bore receptacle configured to seal with the second tubular, thereby providing a sealed connection therebetween.

Disclosed herein is a tie back seal system. The system includes tubular members receptive for forming a tie back seal assembly therein. The tie back seal assembly includes two telescoping tubular with the overlapping slip fit portions, at least one which is made from plastically deformable metallic material. The interior tubular having radially extending annular protrusions thereon, which when the tubular are plastically deformed to form a tie back seal, the protrusions engage the interior of the outer tubular to improve the sealing and durability of the seal system.

Further disclosed herein is a method of sealing a tie back to a tubular. The method includes: positioning a metal deformable tubular member of the tie back within an outer tubular member; expanding the deformable tubular in a radial direction to contact the outer tubular. The expanding step causing the protrusions to engage the outer tubular creating annular contact areas comprising plastic deformation of the interior all of outer tubular member.

Further disclosed herein is a tie back system and method wherein the axially spaced protrusions on the outer surface of interior tubular member that have a generally triangular-shaped cross section.

BRIEF DESCRIPTION OF THE DRAWINGS

The drawings are incorporated into and form a part of the specification to illustrate at least one embodiment and example of the present invention. Together with the written description, the drawings serve to explain the principles of the invention. The drawing is only for the purpose of illustrating at least one preferred example of at least one embodiment of the invention and is not to be construed, as limiting the invention to only the illustrated and described example or examples. The various advantages and features of the various embodiments of the present invention will be apparent from a consideration of the drawing in which.

DETAILED DESCRIPTION

Figure 1:
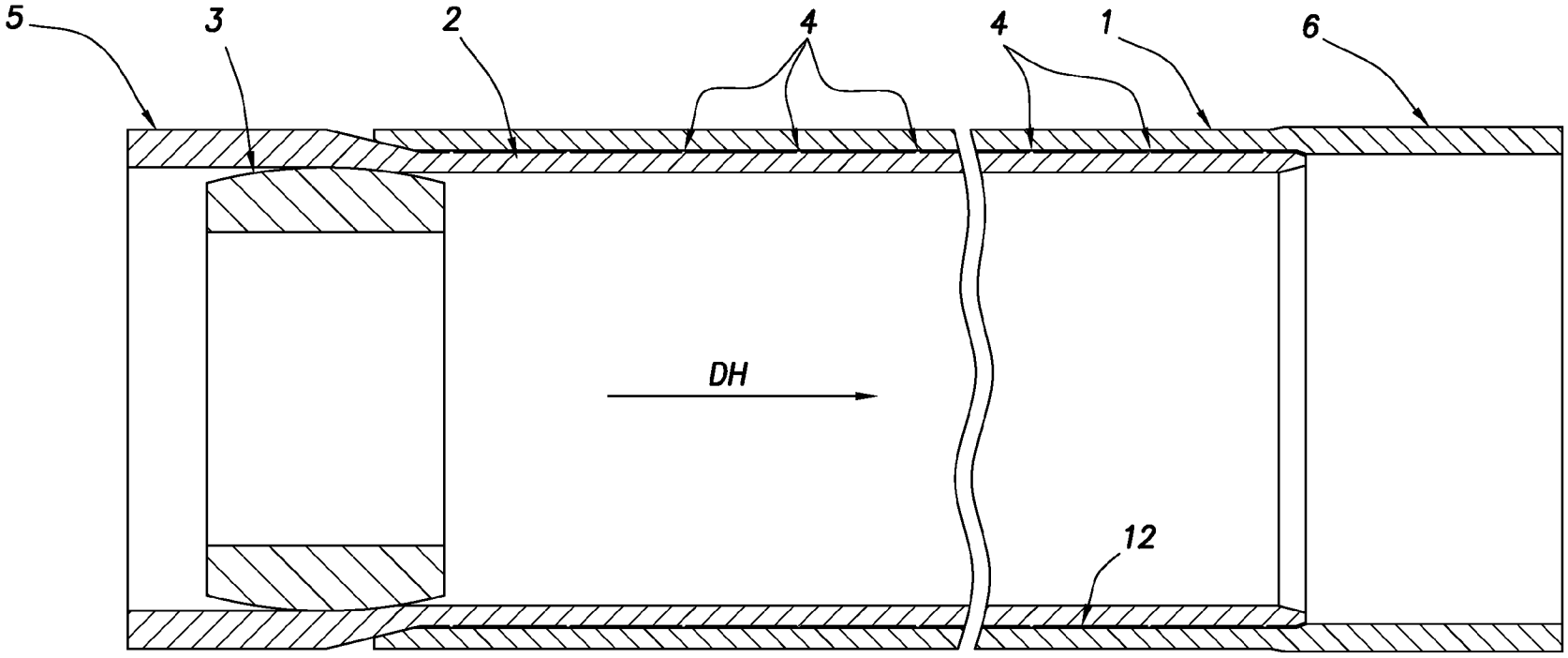
FIG. 1 is a tie back seal system configuration of the present invention, illustrated in a longitudinal section prior to expansion.

Embodiments of the present invention generally relate to methods and apparatus for completing a well. Particularly, the invention relates to a system of completing a wellbore through the expansion of one or more tubular members. More particularly, embodiments of the present invention relate to the concurrent expansion of a first and second tubular, wherein the first tubular contains a polished bore receptacle for forming a tie back seal, configured to sealingly receive a portion of the second tubular, thereby providing a sealable connection therebetween.

Referring more particularly to the drawings, wherein like reference characters are used throughout the various figures to refer to like or corresponding parts, there is shown in the figures, one embodiment of the tie back seal system of the present invention.

Figure 1A:
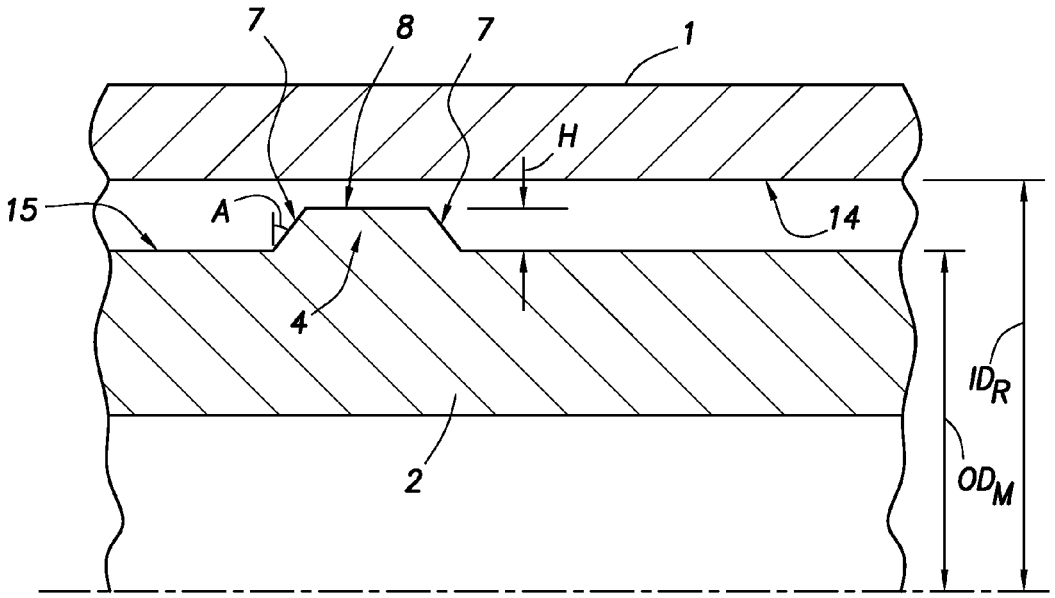
FIG. 1A is an enlarged cross section from FIG. 1.

Turning first to FIGS. 1 and 1A, one embodiment of the metal to metal tie back seal configuration used to form a seal between well tubing 5 and well tubing 6. The well tubing 6 has been run (installed) into a cased portion of the wellbore (not shown) and hung mounted in the wellbore. The mounting is not shown but methods of hanging the tubing 6 in the wellbore are well known in the industry. The tubing 5 has been lowered into the wellbore and the lower end inserted in a down hole direction DH into the upper end of the tubing 6.

In this embodiment, the telescoped or overlapping portion of well tubing 5 comprises a de back seal mandrel 2. The telescoped or overlapping portion of well tubing 6 cot a tie back seal receptacle 1. The receptacle can be M the form or a polished bore receptacle. For descriptive purposes, the cone 3 of an expander tool is illustrated in FIG. 1 in position to be moved through the tie back seal assembly to deform the seal mandrel 2 into scaling engagement with the tie back receptacle 1.

Tie back seal mandrel 2 comprises a tubular member made from deformable metallic material. Mandrel 2 has an outer diameter and wall thickness which when compared to the well tubing 5 is smaller and thinner, respectively. The wall thickness of the tie back receptacle 1 is thinner than the wall thickness of the well tubing 6.

According to a particular feature, the present invention uses a plurality of radially extending metallic protrusions or ridges 4 which are preferably integrally formed on the reduced diameter outer surface of the seal mandrel 2. These protrusions can be integrally formed on the tubular members, for example, by casting and/or machining. Ridges 4 are axially spaced apart a distance D. Ridges 4 are annular shaped in that they extend continuously around the circumference of the seal mandrel 2 outer surface. In other words, each protrusion is endless or ring shaped as contrasted with the spiral pattern with ends that is present in a threaded connection. As illustrated in detail in FIG. 1A, these protrusions 4 have a tapered cross section which in this embodiment is generally triangular cross-section shaped with the opposed sidewalls 7 inclined toward each other at an angle A in the range of about 30° to about 60°. The outer apexes of each of the ridges 4 are flattened to form annular outer walls 8, in the preferred embodiment, walls 8 have a cylindrical shape to form a cylindrical contact area. However, it is envisioned that the walls 8 could have a surface that appears concave or convex when viewed in a cross section, such as FIG. 1A.

Figure 2A:
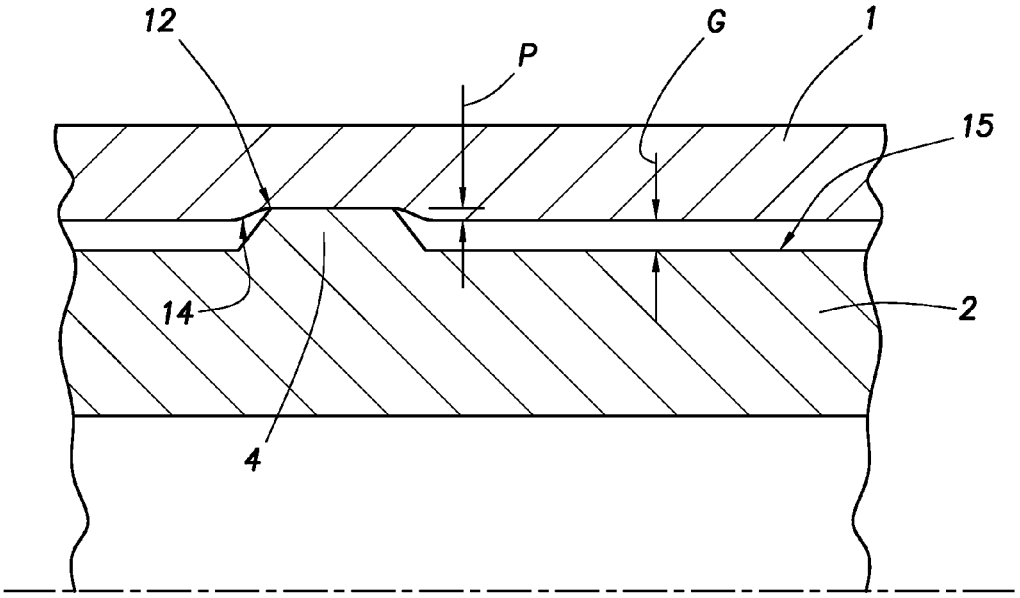
FIG. 2A is an enlarged cross section from FIG. 2.
Figure 2:
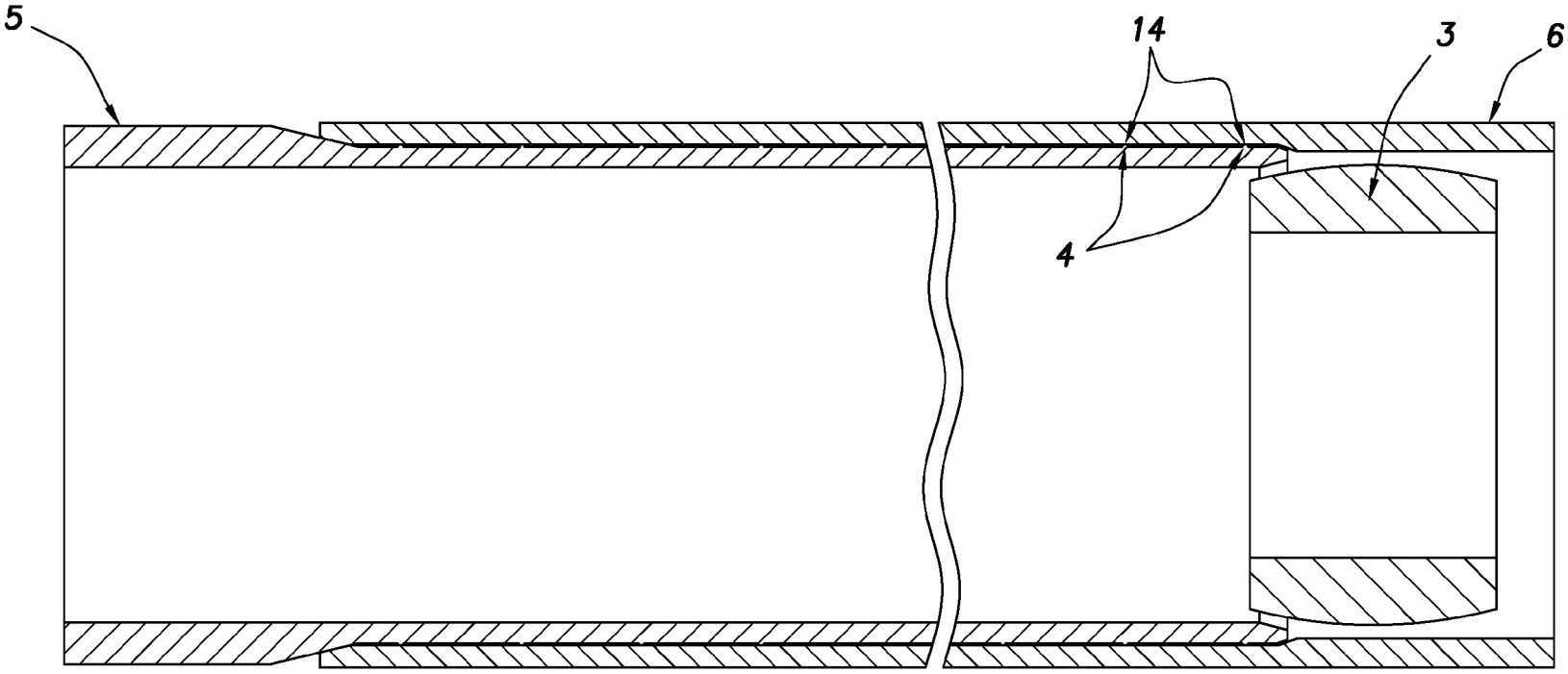
FIG. 2 is a tie back seal system configuration of the present invention, illustrated in longitudinal section subsequent to expansion.

FIGS. 2 and 2A graphically illustrate the metal to metal tie back seal configuration after it has been made up by the cone of expander tool 3. As is illustrated, the cone 3 of the expander tool can elastically contact the tie back receptacle 1 or deform the tie back mandrel 2 and tie hack receptacle 1 in the area of contact. According to a particular feature of the present invention, the protrusions 4 can deform and/or be embedded in the inner wall of the tie back receptacle 1 to form an annular contact area which acts as a metallic annular seal.

As illustrated in diagram form in FIG. 2A, it is anticipated that protrusions 4 can cause plastic deformations 12 to occur in the inner wall 14 of the tie back receptacle 1 as the expansion process is performed, in FIG. 2A, the deformations 12 penetrate a distance "P" into the internal surface 14. It is also believed that the protrusions 4 can likewise be plastically deformed during the expansion process. As a result of the engagement between the protrusions 4 and the deformations 12, a plurality of circumferentially extending annular metal to metal contact areas are created, forming a plurality annular seals spaced along the length of the seal assembly. Also, as illustrated in FIG. 2A, a gap "G" may be formed at the interface between the internal surface 14 of the tie back receptacle 1 and the external surface 15 of the seal mandrel 2. The gap "G" may be present along all or portions of the interface where the protrusions are not present.

The interaction between the protrusions 4 and interior wall surface of the tie back receptacle 14 can be altered by the selection of materials for the tubing sections. By forming the receptacle from relatively hard material and the mandrel with a lesser hardness, more deformation of the protrusions would be expected. The dimensions of the sections and cone can be selected to vary the expansion process and amount of deformation in the sealing area.

In another embodiment, the protrusions illustrated in FIG. 1A, are formed on the interior wall of the tie back receptacle, instead of or in addition to the protrusions on the tie back receptacle.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of completing a well, the well having a cased wellbore section, the method comprising:

placing a first tubular member in the well, and hanging the first tubular member in the cased wellbore section at a subterranean location;

placing a second tubular member in the well so that a portion of the second tubular member is telescoped into a portion of the first tubular member and a portion of an outer surface of the second tubular member extends adjacent to a portion of an inner surface of the first tubular member, the respective telescoped portions of the first and second tubular members having reduced wall thicknesses relative to respective remaining portions of the first and second tubular members, and a plurality of metallic annular protrusions each being formed on at least one of the adjacent inner and outer surfaces; and expanding the second tubular member so that the each of the metallic annular protrusions is in sealing contact with, and plastically deforms, at least the other of the adjacent inner and outer surfaces on which said metallic annular protrusion is not formed, wherein, when each metallic annular protrusion initially contacts the other of the adjacent inner and outer surfaces, gaps are present on opposing axial sides of said metallic annular protrusion, said gaps being partially closed upon expansion of the second tubular member.

2. The method according to claim 1, wherein the metallic annular protrusions are integrally formed on the at least one of the adjacent inner and outer surfaces, and wherein the annular protrusions each have a flattened outer apex.

3. The method according to claim 1, wherein the metallic annular protrusions are axially spaced on the at least one of the adjacent inner and outer surfaces.

4. The method according to claim 1, wherein expanding the second tubular member comprises forming metallic annular seals between the adjacent inner and outer surfaces of the first and second tubular members.

5. The method according to claim 1, wherein each of the metallic annular protrusions extends continuously around the at least one of the adjacent inner and outer surfaces on which said metallic annular protrusion is formed.

6. The method according to claim 5, wherein expanding the second tubular member comprises forming contact areas between each of the metallic annular protrusions and the other of the adjacent inner and outer surfaces on which said metallic annular protrusion is not formed, and wherein the contact areas are endless.

7. The method according to claim 1, wherein at least one of the metallic annular protrusions has a tapered cross section.

8. The method according to claim 1, wherein at least one of the metallic annular protrusions comprises a generally triangular cross-section shape.

9. The method according to claim 1, wherein at least one of the metallic annular protrusions comprises opposed annular side walls inclined toward each other at angles of about 30 to 60 degrees.

10. The method according to claim 1, wherein at least one of the metallic annular protrusions has an outer annular wall for contacting the other of the adjacent inner and outer surfaces on which said metallic annular protrusion is not formed.

11. The method according to claim 1, wherein the plurality of metallic annular protrusions are integrally formed on both of the adjacent inner and outer surfaces of the first and second tubular members.

12. A wellbore tubing connection for use in connecting tubing at a subterranean location, the wellbore tubing connection comprising:

first and second tubular members;

an end portion of the second tubular member that is telescopically receivable into an end portion of the first tubular member to form an overlapping area so that an inner surface of the first tubular member extends adjacent to an outer surface of the second tubular member, the respective telescoped end portions of the first and second tubular members having reduced wall thicknesses relative to respective remaining portions of the first and second tubular members; and a plurality of annular-shaped, radially extending metallic protrusions each formed on at least one of the adjacent inner and outer surfaces, wherein, when the end portion of the second tubular member is telescoped into the end portion of the first tubular member, the second tubular member is expandable so that the each of the protrusions is in sealing contact with, and plastically deforms, at least the other of the adjacent inner and outer surfaces on which said protrusion is not formed, and wherein, when each protrusion initially contacts the other of the adjacent inner and outer surfaces, gaps are present on opposing axial sides of said protrusion, said gaps being partially closed upon expansion of the second tubular member.

13. The connection according to claim 12, wherein the protrusions are integrally formed on the second tubular member.

14. The connection according to claim 12, wherein the protrusions are integrally formed on the first tubular member.

15. The connection according to claim 12, wherein the protrusions are integrally formed on both the first and second tubular members.

16. The connection according to claim 12, wherein the annular protrusions are axially spaced on the at least one of the adjacent inner and outer surfaces.

17. The connection according to claim 12, wherein the protrusions form metallic annular seals between the adjacent inner and outer surfaces of the first and second tubular members.

18. The connection according to claim 12, wherein the plurality of protrusions each extend continuously around the at least one of the adjacent inner and outer surfaces.

19. The connection according to claim 12, wherein contact areas are formed between each of the protrusions and the other of the inner and outer surfaces on which said protrusion is not formed, and wherein the contact areas are endless.

20. The connection according to claim 12, wherein at least one of the protrusions has a tapered cross section.

21. The connection according to claim 12, wherein at least one of the protrusions comprises a generally triangular cross-section shape.

22. The connection according to claim 12, wherein at least one of the protrusions comprises opposed annular side walls inclined toward each other at angles of about 30 to 60 degrees.

23. The connection according to claim 12, wherein at least one of the protrusions has an outer annular wall for contacting the other of the inner and outer surfaces on which said protrusion is not formed.

* * * * *